US009076453B2

(12) United States Patent
Grancharov

(10) Patent No.: US 9,076,453 B2
(45) Date of Patent: Jul. 7, 2015

(54) METHODS AND ARRANGEMENTS IN A TELECOMMUNICATIONS NETWORK

(71) Applicant: TELEFONAKTIEBOLAGET L M ERICSSON (PUBL), Stockholm (SE)

(72) Inventor: Volodya Grancharov, Solna (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 0 days.

(21) Appl. No.: 14/278,934

(22) Filed: May 15, 2014

(65) Prior Publication Data

US 2014/0249808 A1 Sep. 4, 2014

Related U.S. Application Data

(63) Continuation of application No. 13/746,143, filed on Jan. 21, 2013, now Pat. No. 8,731,917, which is a continuation of application No. 12/529,391, filed as application No. PCT/EP2007/061796 on Mar. 2, 2007, now abandoned.

(60) Provisional application No. 60/892,670, filed on Mar. 2, 2007.

(51) Int. Cl.
*G10L 19/00* (2013.01)
*G10L 21/00* (2013.01)
(Continued)

(52) U.S. Cl.
CPC ..... *G10L 21/02* (2013.01); *G10L 19/26* (2013.01); *G10L 21/0205* (2013.01); *G10L 21/003* (2013.01); *G10L 21/013* (2013.01)

(58) Field of Classification Search
CPC ..... G10L 19/26; G10L 21/003; G10L 21/007; G10L 21/013; G10L 21/0205
USPC ..... 704/228, 200.1, 205, 207
See application file for complete search history.

(56) References Cited

U.S. PATENT DOCUMENTS 4,471,453 A 9/1984 Ney et al.
4,624,008 A * 11/1986 Vensko et al. ..... 704/253
(Continued)

FOREIGN PATENT DOCUMENTS

CN 1677493 A 10/2005
EP 1271472 A 1/2003
(Continued)

OTHER PUBLICATIONS

Source-Controlled Variable-Rate Multimode Wideband Speech Codec (VMR-WB), Service Options 62 and 63 for Spread Spectrum Systems. 3GPP2 C.S0052-A. Version 1.0. Apr. 22, 2005.
(Continued)

*Primary Examiner* — Eric Yen

(57) ABSTRACT

The present invention relates to a postfilter and a postfilter control to be associated with a postfilter for improving perceived quality of speech reconstructed at a speech decoder. The postfilter control comprises means for measuring stationarity of a speech signal reconstructed at a decoder, means for determining a coefficient to a postfilter control parameter based on the measured stationarity, and means for transmitting the determined coefficient to a postfilter, such that the postfilter can process the reconstructed speech signal by applying the determined coefficient to the postfilter control parameter to obtain an enhanced speech signal.

20 Claims, 6 Drawing Sheets

(51) Int. Cl.

| | |
|---|---|
| ***G10L 25/90*** | (2013.01) |
| ***G10L 21/02*** | (2013.01) |
| ***G10L 19/26*** | (2013.01) |
| ***G10L 21/003*** | (2013.01) |
| ***G10L 21/013*** | (2013.01) |

(56) References Cited

U.S. PATENT DOCUMENTS

| | | | | |
|---|---|---|---|---|
| 4,742,547 | A * | 5/1988 | Watanabe | 704/241 |
| 4,905,288 | A * | 2/1990 | Gerson et al. | 704/245 |
| 5,533,052 | A | 7/1996 | Bhaskar | |
| 5,758,027 | A | 5/1998 | Meyers et al. | |
| 5,774,849 | A * | 6/1998 | Benyassine et al. | 704/246 |
| 5,987,406 | A | 11/1999 | Honkanen et al. | |
| 6,075,475 | A | 6/2000 | Ellis et al. | |
| 6,122,609 | A | 9/2000 | Scalart et al. | |
| 6,138,093 | A * | 10/2000 | Ekudden et al. | 704/228 |
| 6,226,638 | B1 | 5/2001 | Okura et al. | |
| 6,324,502 | B1 | 11/2001 | Handel et al. | |
| 6,427,134 | B1 * | 7/2002 | Garner et al. | 704/233 |
| 6,556,967 | B1 | 4/2003 | Nelson et al. | |
| 6,633,845 | B1 * | 10/2003 | Logan et al. | 704/255 |
| 7,010,052 | B2 | 3/2006 | Dill et al. | |
| 7,016,846 | B2 | 3/2006 | Bruekers et al. | |
| 7,149,683 | B2 | 12/2006 | Jelinek | |
| 7,191,123 | B1 | 3/2007 | Bessette et al. | |
| 7,286,986 | B2 | 10/2007 | Talkin | |
| 7,933,644 | B2 | 4/2011 | Wong et al. | |
| 8,108,164 | B2 * | 1/2012 | Joublin et al. | 702/75 |
| 8,332,213 | B2 | 12/2012 | Gournay et al. | |
| 2001/0050987 | A1 | 12/2001 | Yeap et al. | |
| 2004/0128125 | A1 | 7/2004 | Makinen et al. | |
| 2004/0181399 | A1 * | 9/2004 | Gao | 704/220 |
| 2005/0043945 | A1 * | 2/2005 | Droppo et al. | 704/226 |
| 2005/0102136 | A1 | 5/2005 | Makinen et al. | |
| 2005/0143974 | A1 | 6/2005 | Joly | |
| 2005/0154584 | A1 * | 7/2005 | Jelinek et al. | 704/219 |
| 2005/0165603 | A1 | 7/2005 | Bessette et al. | |
| 2005/0232440 | A1 | 10/2005 | Roovers | |
| 2005/0261897 | A1 | 11/2005 | Jelinek | |
| 2006/0111900 | A1 | 5/2006 | Kim | |
| 2006/0256764 | A1 * | 11/2006 | Yang et al. | 370/342 |
| 2006/0293885 | A1 * | 12/2006 | Gournay et al. | 704/223 |
| 2008/0159559 | A1 * | 7/2008 | Akagi et al. | 381/92 |
| 2010/0172407 | A1 | 7/2010 | Ramaswamy | |

FOREIGN PATENT DOCUMENTS

| | | | |
|---|---|---|---|
| EP | 1852851 | A1 | 11/2007 |
| JP | S61-184912 | | 8/1986 |
| JP | H10-116097 | | 5/1998 |
| WO | WO 98/39768 | A | 9/1998 |
| WO | WO 2005/081231 | A1 | 9/2005 |

OTHER PUBLICATIONS

3rd Generation Partnership Project; Technical Specification Group Service and System Aspects; Audio Codec processing functions; Extended Adaptive Multi-Rate—Wideband (AMR-WB+) codec; Transcoding functions (Release 6). 3GPP TS 26.290 v6.3.0. (Jun. 2005).

Petter Knagenhjelm H, et al.: "Spectral dynamics is more important than spectral distortion", Acoustics, Speech, And Signal Processing, 1995. ICASSP-95., 1995 International Conference On Detroit, Mi, USA May 9-12, 1995, New York, NY, USA, IEEE, US, vol. 1, (May 9, 1995), XP010151322, ISBN: 0-7803-2431-5.

Quatieri T F, et al.: "Speech enhancement based on auditory spectral change". Orlando, FL, May 13-17, 2002, IEEE International Conference On Acoustics, Speech, And Signal Processing (I CASSP), New York, NY: IEEE, US, vol. 4 of 4, (May 13, 2002) XP010804743, ISBN: 0-7803-7402-9.

* cited by examiner

METHODS AND ARRANGEMENTS IN A TELECOMMUNICATIONS NETWORK

PRIORITY CLAIM UNDER 35 U.S.C. §119(e)

This application is a continuation of U.S. Non-Provisional Ser. No. 13/746,143, filed Jan. 21, 2013, entitled "Methods and Arrangements in a Telecommunications Network" which is a 371 of International Application No. PCT/EP07/61796, filed Nov. 10, 2007, entitled "Methods and Arrangements in a Telecommunications Network", and claims the benefit of U.S. Provisional Application No. 60/892,670, filed Mar. 2, 2007, entitled "Speech Enhancement Post-Processor, Controlled by Signal Stationarity," which is incorporated by reference in its entirety.

TECHNICAL FIELD

The present invention relates to postfilter algorithms, used in speech and audio coding. In particular the present invention relates to methods and arrangements for providing an improved postfilter.

BACKGROUND

In a communication network transmitting speech or audio, the original speech 100 or audio is encoded by an encoder 101 at the transmitter and an encoded bitstream 102 is transmitted to the receiver as illustrated by FIG. 3. At the receiver, the encoded bitstream 102 is decoded by a decoder 103 that reconstructs the original speech and audio signal into a reconstructed speech (or audio) 104 signal. Speech and audio coding introduces quantization noise that impairs the quality of the reconstructed speech. Therefore postfilter algorithms 105 are introduced. The state-of the art postfilter algorithms 105 shape the quantization noise such that it becomes less audible. Thus the existing postfilters improve the perceived quality of the speech signal reconstructed by the decoder such that an enhanced speech signal 106 is provided. An overview of postfilter techniques can be found in J. H. Chen and A. Gersho, "Adaptive postfiltering for quality enhancement of coded speech", IEEE Trans. Speech Audio Process, vol. 3, pp. 58-71, 1985.

All existing postfilters exploit the concept of signal masking. It is an important phenomenon in human auditory system. It means that a sound is inaudible in the presence of a stronger sound. In general the masking threshold has a peak at the frequency of the tone, and monotonically decreases on both sides of the peak. This means that the noise components near the tone frequency (speech formants) are allowed to have higher intensities than other noise components that are farther away (spectrum valleys). That is why existing postfilters adapt on a frame-basis to the formant and/or pitch structures in the speech, in the form of autoregressive (AR) coefficients and/or pitch period.

The most popular postfilters are the formant (short-term) postfilter and pitch (long-term) postfilter. A formant postfilter reduces the effect of quantization noise by emphasizing the formant frequencies and deemphasizing the spectral valleys. This is illustrated in FIG. 1, where the continuous line shows an autoregressive envelope of a signal before postfiltering and the dashed line shows an autoregressive envelope of a signal after postfiltering. The pitch postfilter emphasizes frequency components at pitch harmonic peaks, which is illustrated in FIG. 2. The continuous line of FIG. 2 shows the spectrum of a signal before postfiltering while the dashed line shows the spectrum of a signal after postfiltering. The plots of FIGS. 1 and 2 concern 30 ms blocks from a narrowband signal. It should also be noted that the plots of FIGS. 1 and 2 do not represent the actual postfilter parameters, but just the concept of postfiltering.

The formants and/or the pitch indicate(s) how the energy is distributed in one frame which implies that the parts of the signal that are masked (that are less audible or completely audible) are indicated. Hence, the existing postfilter parameter adaptation exploits the signal-masking concept, and therefore adapt to the speech structures like formant frequencies and pitch harmonic peaks. These are all in-frame features (such as pitch period giving pitch harmonic peaks and autoregressive coefficients determining formants), calculated under the assumption that speech is stationary for the current frame (e.g., 20 ms speech).

In addition to signal masking, an important psychoacoustical phenomenon is that if the signal dynamics are high, then distortion is less objectionable. It means that noise is aurally masked by rapid changes in the speech signal. This concept of aurally masking the noise by rapid changes in the speech signal is already in use for speech coding in H. Knagenhjelm and W. B. Kleijn, "Spectral dynamics is more important than spectral distortion", ICASSP, vol. 1, pp. 732-735, 1995 and for enhancement in T. Quateri and R. Dunn, "Speech enhancement based on auditory spectral change", ICASSP, vol. 1, pp. 257-260, 2002. In H. Knagenhjelm and W. B. Kleijn adaptation to spectral dynamics is used in line spectral frequencies (LSF) quantization. In T. Quateri and R. Dunn adaptation to spectral dynamics is used in a pre-processor for background noise attenuation.

SUMMARY

However, the existing postfilter solutions do not take into consideration the fact that less suppression should be performed when the speech information content is high, and more suppression should be performed when the signal is in a steady-state mode.

Thus an object with the present invention is to improve the perceived quality of reconstructed speech.

This object is achieved by the present invention by means of the improved postfilter control parameter, wherein a determined coefficient based on signal stationarity is applied to a conventional postfilter control parameter to achieve the improved postfilter control parameter.

In accordance with a first aspect of the present invention a method for a postfilter control is provided. The method improves perceived quality of speech reconstructed at a speech decoder and comprises the steps of measuring stationarity of a speech signal reconstructed at a decoder, determining a coefficient to a postfilter control parameter based on the measured stationarity, and transmitting the determined coefficient to a postfilter, such that the postfilter can process the reconstructed speech signal by applying the determined coefficient to the postfilter control parameter to obtain an enhanced speech signal.

In accordance with a second aspect of the present invention a method in a postfilter for improving perceived quality of speech reconstructed at a speech decoder is provided. The method comprises the steps of receiveing a determined coefficient to the postfilter, and processing the reconstructed speech signal by applying the determined coefficient to the postfilter control parameter to obtain an enhanced speech signal, wherein the coefficient is determined based on a measured stationarity of the speech signal reconstructed at a decoder.

In accordance with a third aspect of the present invention a postfilter control to be associated with a postfilter for improving perceived quality of speech reconstructed at a speech decoder is provided. The postfilter control comprises means for measuring stationarity of a speech signal reconstructed at a decoder, means for determining a coefficient to a postfilter control parameter based on the measured stationarity, and means for transmitting the determined coefficient to a postfilter, such that the postfilter can process the reconstructed speech signal by applying the determined coefficient to the postfilter control parameter to obtain an enhanced speech signal.

In accordance with a fourth aspect of the present invention a postfilter for improving perceived quality of speech reconstructed at a speech decoder is provided. The postfilter comprises means for receiveing a determined coefficient to the postfilter, and a processor for processing the reconstructed speech signal by applying the determined coefficient to the postfilter control parameter to obtain an enhanced speech signal, wherein the coefficient is determined based on a measured stationarity of the speech signal reconstructed at a decoder.

An advantage with the present invention is that the adaptation of the postfilter parameters to the spectral dynamics offers a simple scheme is compatible with existing postfilters.

DETAILED DESCRIPTION

The basic concept of the present invention is to modify an existing postfilter such that it adapts to spectral dynamics of a decoded speech signal. (It should be noted, that even if the term speech is used herein, the specification also relates to any audio signal.) Spectral dynamics implies a measure of the stationarity of the signal, defined as the Euclidean distance between spectral densities of two neighbouring speech segments. If the Euclidean distance between two speech segments is high, then the attenuation should be reduced compared with a situation when the Euclidean distance is low.

The modified postfilter according to the present invention makes it possible to suppress more noise when the dynamics are low and to suppress less if the dynamics are high, e.g. during formant transitions and vowel onsets.

This account for the fact that the average level of quantization noise may not change rapidly in time, but in some parts of the signal the noise will be more audible than in other parts.

It should be noted that the postfilter control does not replace the conventional postfilter adaptation that is motivated by the signal masking phenomenon but is a complementary adaptation that exploits additional properties of human auditory system, thus improving quality of the conventional postfilter solutions.

Figure 1:
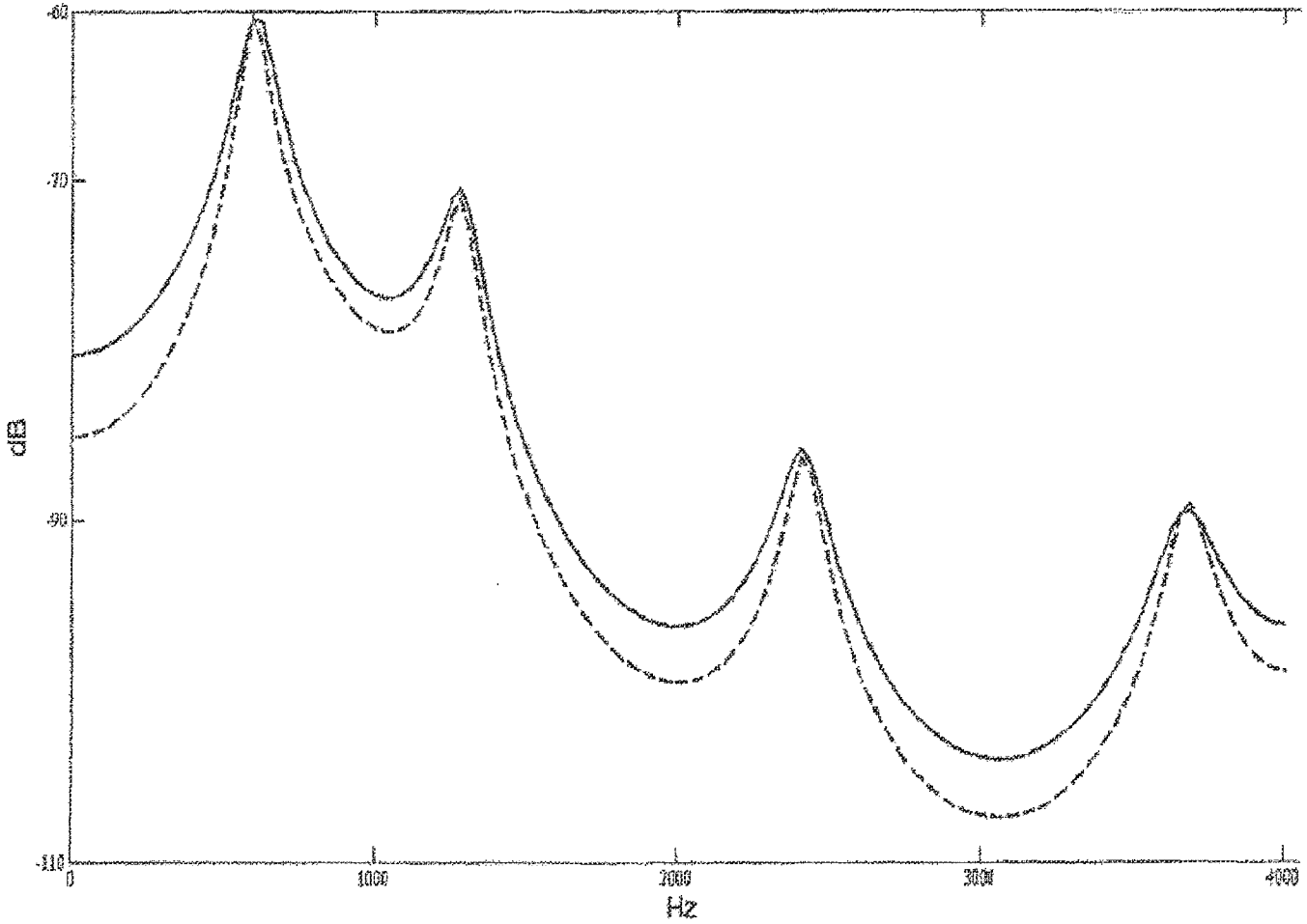
FIG. 1 illustrates the effect of a formant postfilter on the reconstructed signal according to prior art.
Figure 2:
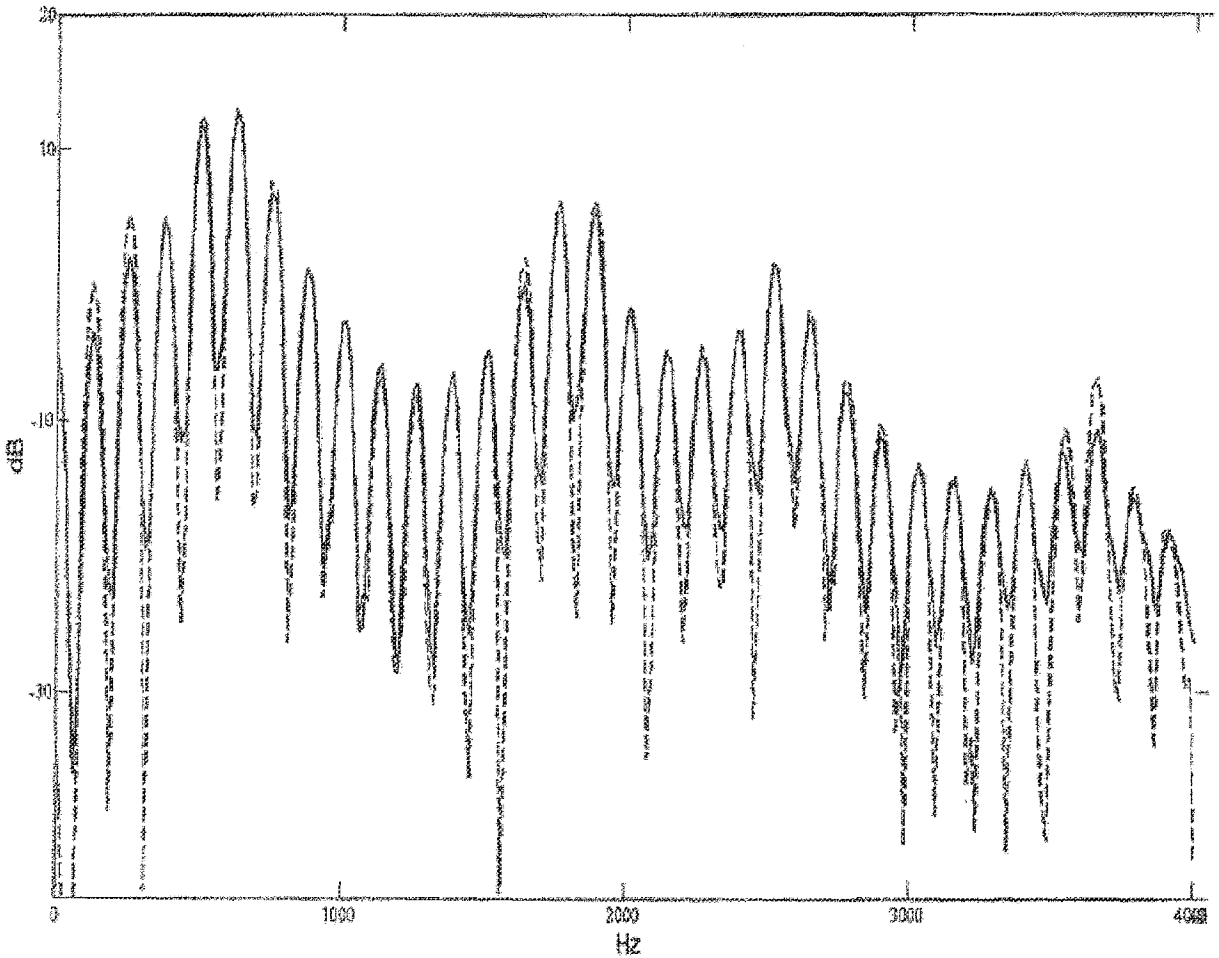
FIG. 2 illustrates the effect of a pitch postfilter on the reconstructed signal according to prior art.
Figure 3:
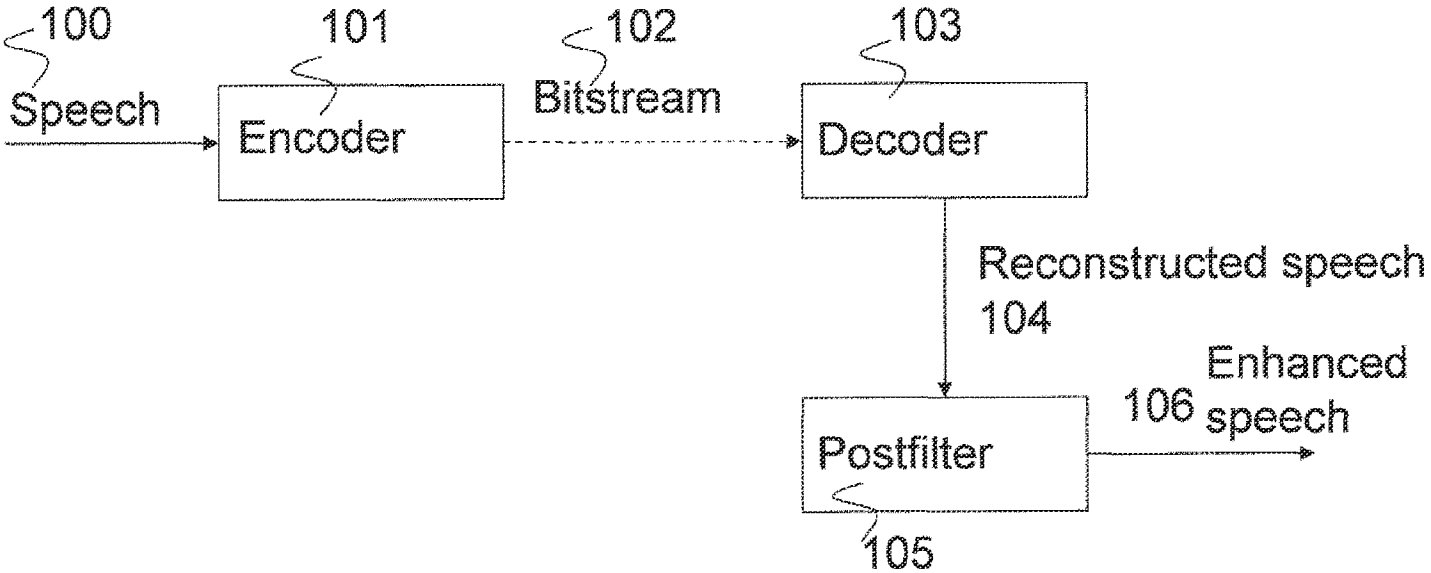
FIG. 3 illustrates schematically an encoder-decoder with a postfilter according to prior art.
Figure 4:
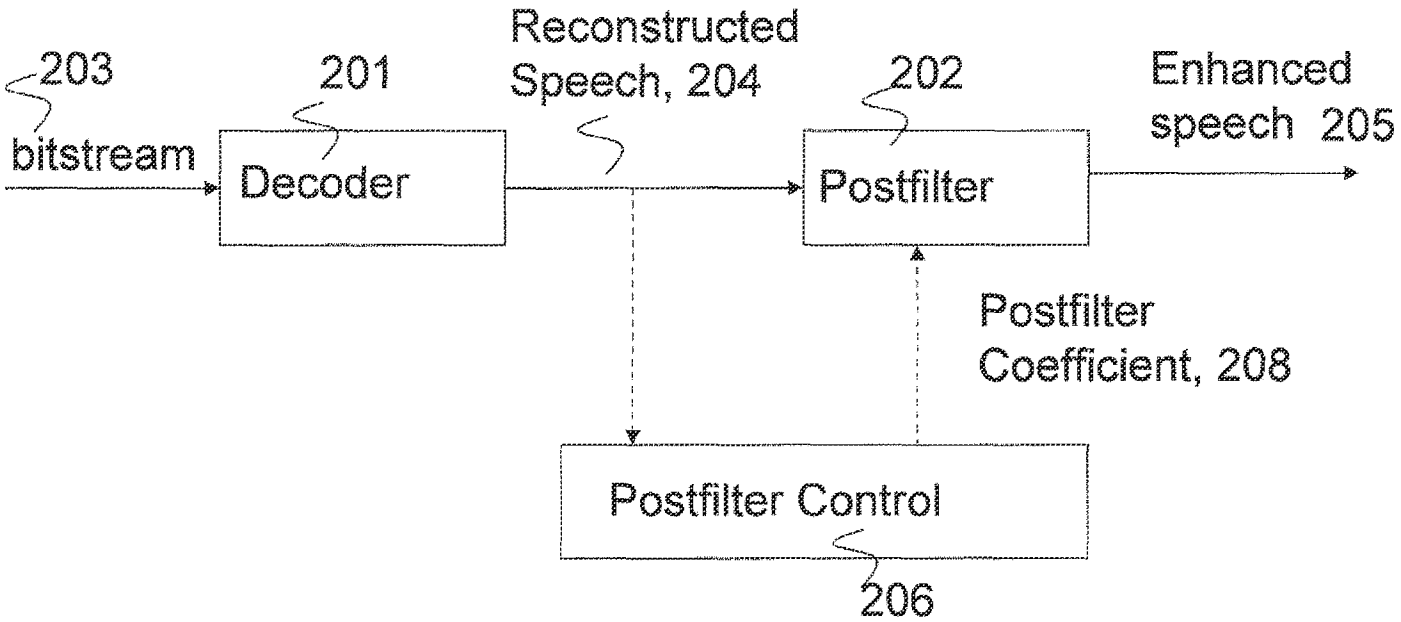
FIG. 4 illustrates schematically an encoder-decoder according to FIG. 1 with the postfilter control of an embodiment of the present invention.

Thus, a postfilter control that adapts the postfilter to spectral dynamics of the decoded signal is introduced according to the present invention. An embodiment of the present invention is illustrated in FIG. 4. FIG. 4 shows a decoder 201 and a postfilter 202. An encoded bitstream 203 is input to the decoder 201 and the decoder 201 decodes the encoded bitstream 203 and reconstructs the speech signal 204. The postfilter control 206 measures the signal stationarity and determines a coefficient 208 (denoted K below) to be transmitted to the postfilter 202. The postfilter 202 processes the reconstructed speech signal by using the conventional postfilter parameters that are modified by the coefficient 208 of the postfilter control 206 such that the postfilter adapts to the spectral dynamics of the decoded signal.

In the following, an implementation of the postfilter control according to one embodiment is disclosed. This implementation is based on a pitch postfilter described in US2005/0165603 A1. This postfilter is also described in 3GPP2 C.S0052-A: "Source-Controlled Variable-Rate Multimode Wideband Speech Codec (VMR-WB), Service Options 62 or 63 for Spread Spectrum Systems", 2005 on p. 154 (equations 6.3.1-1 and 6.3.1-2). The pitch postfilter has the form of $$\hat{s}_f(k) = (1-\alpha)\hat{s}(k) + \frac{\alpha}{2}(\hat{s}(k-T) + \hat{s}(k+T))$$

$\hat{s}_f$ postfilter output 205

$\hat{s}$ postfilter input 204

T pitch period k is the index of the speech samples in one frame $\alpha$ attenuation control parameter 208 (This may be a function of normalized pitch correlation as in 3GPP2 C.S0052-A: "Source-Controlled Variable-Rate Multimode Wideband Speech Codec (VMR-WB), Service Options 62 or 63 for Spread Spectrum Systems", 2005.)

All postfilters has at least a control parameter $\alpha$ that is adjusted to obtain an enhanced speech. It should be noted that this control parameter is not limited to $\alpha$ described in 3GPP2 C.S0052-A. This adjustment of $\alpha$ may be based on listening tests. In the pitch postfilter described above, the value of the control parameter $\alpha$ depends on how stable (degree of voiceness) the pitch is, since the pitch exists in voiced frames.

Due to complexity reasons, instead of determining the spectral distance between adjacent frames, the immitance spectral frequencies (ISF) distance is determined in this implementation. ISF is a representation of autoregressive coefficients (also called linear predictive coefficients).

Another commonly used representation is Line Spectral Frequencies (LSF). The distance between ISF:s or LSF:s of neighbouring frames is an approximation of the spectral dynamics, since these are parametric representations of the spectral envelope.

In 3GPP2 c.S0052-A: "Source controlled variable-rate multimode wideband speech codec (VMR-WB), Service options 62 and 63 for spread spectrum systems", 2005, on page 151 the ISF distance is calculated and converted to a stability factor $\theta$:

$$\theta = 1.25 - \frac{ISF_{dist}}{40000} \quad ISF_{dist} = \sum_{i=0}^{14} (f_i - f_i^{past})^2$$

This stability factor θ is just a normalization of the ISF distance and is hence used for determining the spectral dynamics in embodiments of the present invention. It should however be noted that other measures such as LSF also can be used for determining the spectral dynamics. The denotation "past" indicates that it is an ISF vector from the previous speech frame. By using this θ and low-passed version of θ, denoted θ_smooth, two parameters $\Psi_1$ and $\Psi_2$ are determined. θ_smooth is important as it measures signal stationarity beyond the current and the previous frame. These two parameters $\Psi_1$ and $\Psi_2$ are used to determine the coefficient K for the attenuation control parameter. According to this embodiment the coefficient is denoted $$K=(1+0.15\Psi_1-2.0\Psi_2)$$

and the new control parameter $\alpha_{stab_adapt}$=K α.

The $\alpha_{stab_adapt}$ determined from the equation above replaces the conventional control parameter. K is defined as a linear combination of $\Psi_1$ and $\Psi_2$. $\Psi_1$ measures the spectral distance between the current and the previous frame. $\Psi_2$ measures how far that distance is to the low-passed distance ($\theta_{smooth}$) of the past frames.

I.e.

$$\alpha_{stab_adapt}=(1+0.15\Psi_1-2.0\Psi_2)\alpha$$

$$\Psi_2=|\theta_{smooth}-\theta|$$

$$\Psi_1=\sqrt{\theta}$$

$$\theta_{smooth}=0.8\theta+0.2\theta^{past}_{smooth}$$

Figure 5:
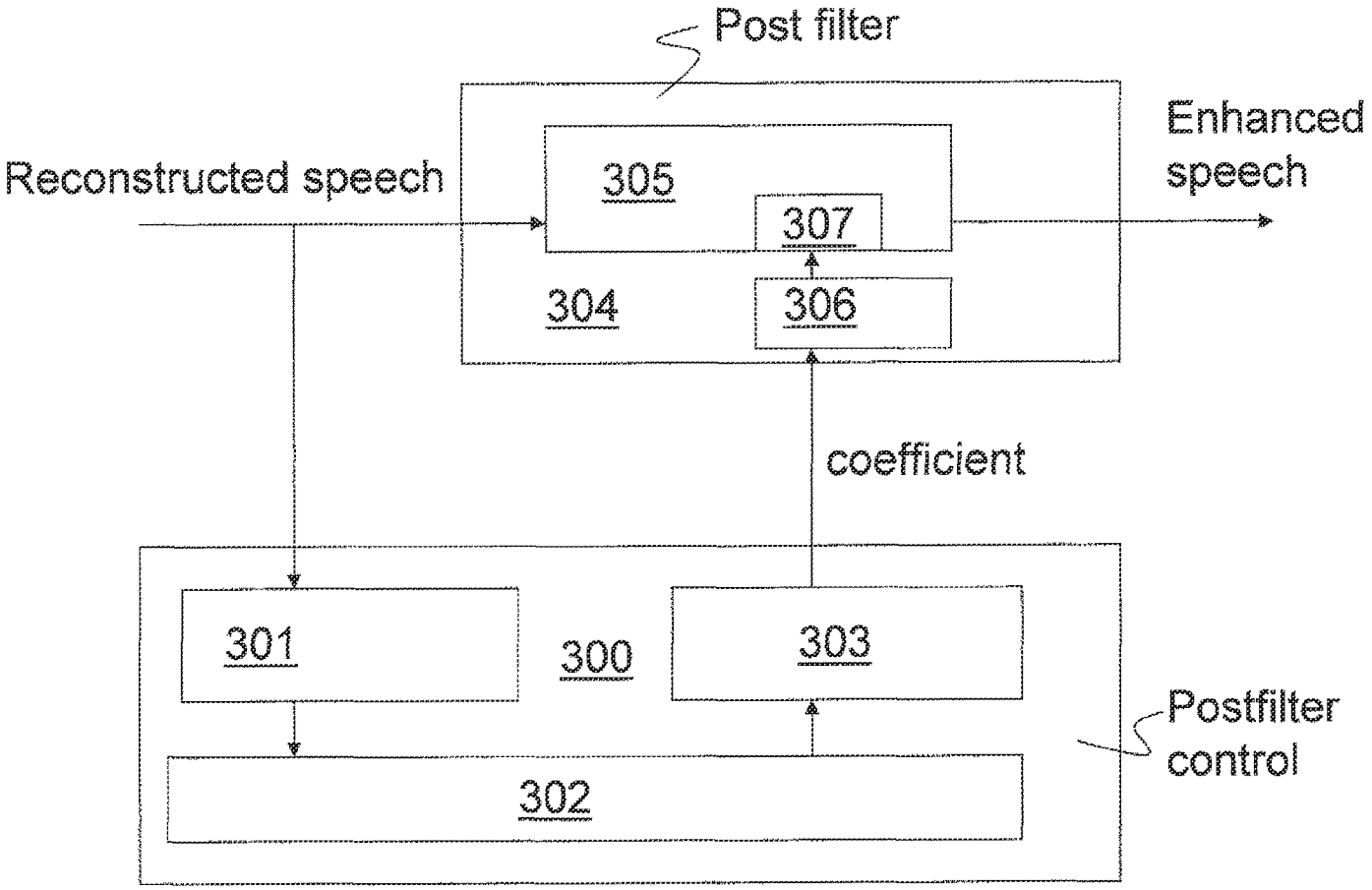
FIG. 5 illustrates schematically a postfilter control and the postfilter according to an embodiment of the present invention.
Figures 6A, 6B:
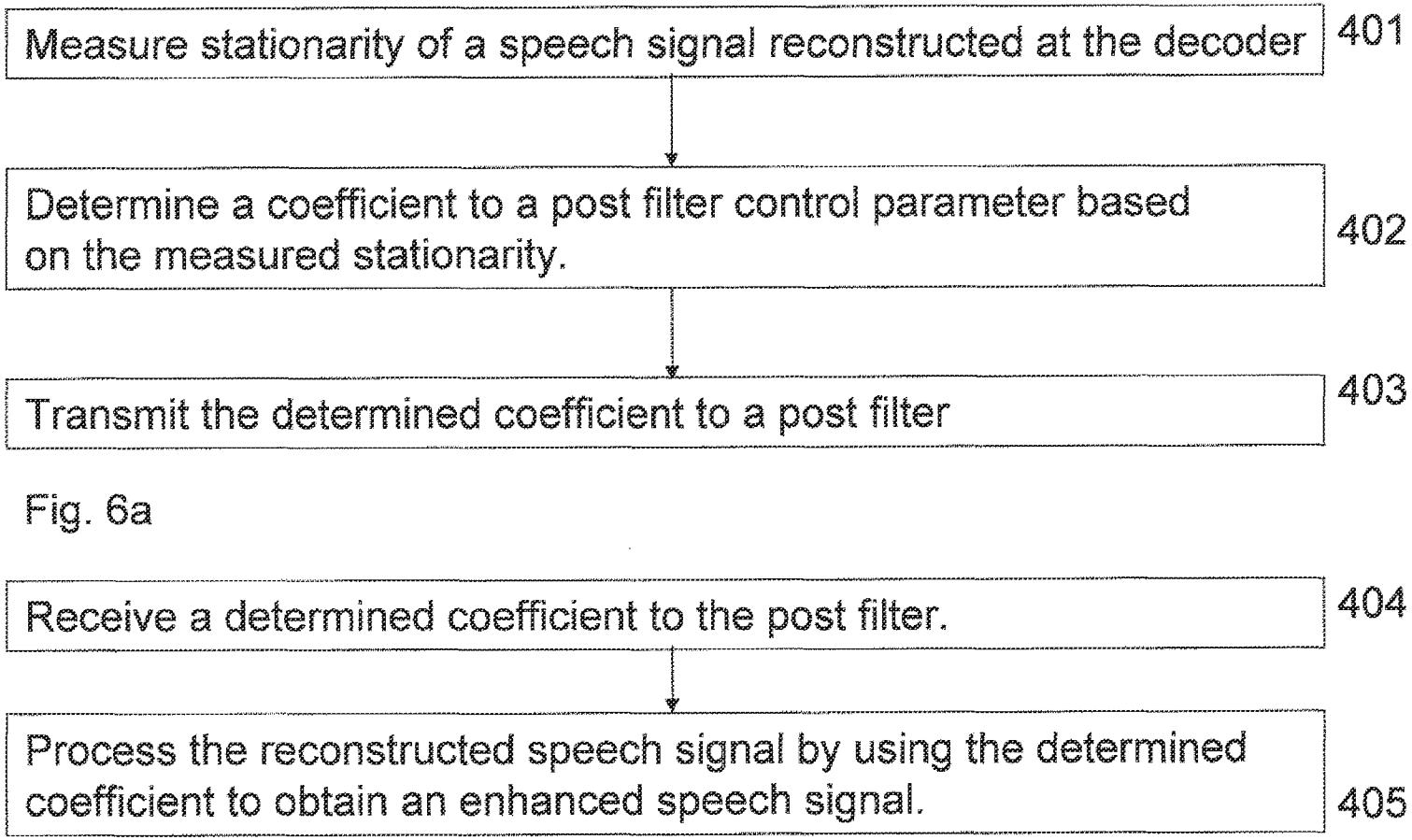
FIGS. 6*a* and 6*b* are flowcharts of the methods according to the present invention.

Thus, the present invention relates to a postfilter control as illustrated in FIG. 5. The postfilter control 300 comprises means for measuring stationarity 301 of a speech signal reconstructed at a decoder, means for determining 302 a coefficient K to a postfilter control parameter based on the measured stationarity, and means for transmitting 303 the determined coefficient to a postfilter, such that the postfilter can process the reconstructed speech signal by using the determined coefficient to obtain an enhanced speech signal.

Moreover, the postfilter 304 of the present invention comprises a postfilter processor 305 and means for receiveing 306 the determined coefficient K to the postfilter, and the postfilter processor 305 comprises means for processing 307 the reconstructed speech signal by applying the determined coefficient K to obtain an enhanced speech signal, wherein the coefficient K is determined based on a measured stationarity of the speech signal reconstructed at a decoder.

Further, the present invention also relates to a method in a postfilter control. The method is illustrated in the flowchart of FIG. 4*a* and comprises the steps of:

401. Measure stationarity of a speech signal reconstructed at a decoder.

402. Determine a coefficient to a postfilter control parameter based on the measured stationarity.

403. Transmit the determined coefficient to a postfilter, such that the postfilter can process the reconstructed speech signal by applying the determined coefficient to the postfilter control parameter to obtain an enhanced speech signal.

A method is also provided for the postfilter as illustrated in the flowchart of FIG. 4*b*. The method comprises the steps of:

404. Receive a determined coefficient to the postfilter.

405. Process the reconstructed speech signal by applying the determined coefficient to the postfilter control parameter to obtain an enhanced speech signal, wherein the coefficient is determined based on a measured stationarity of the speech signal reconstructed at a decoder.

The present invention is not limited to the above-described preferred embodiments. Various alternatives, modifications and equivalents may be used. Therefore, the above embodiments should not be taken as limiting the scope of the invention, which is defined by the appending claims.

The invention claimed is:

1. A method for controlling a postfilter for improving perceived quality of speech reconstructed at a speech decoder, the method comprises the steps of:

measuring, using a processor, stationarity of a speech signal reconstructed at a decoder, by determining a spectral distance between adjacent frames of the speech signal, adaptively determining, using the processor, a coefficient to a postfilter control parameter, such that when the spectral distance is determined to be high, a degree of deemphasizing of spectral valleys in a spectral envelope of the reconstructed speech signal is reduced compared with a situation when the spectral distance is determined to be low, and transmitting, using the processor, the determined coefficient to the postfilter, such that the postfilter can process the reconstructed speech signal by applying the determined coefficient to the postfilter control parameter to obtain an enhanced speech signal.

2. The method according to claim 1, wherein the spectral distance is an immittance spectral frequencies (ISF) distance.

3. The method of claim 1, wherein the spectral distance is a line spectral frequencies (LSF) distance.

4. The method according to claim 1, wherein the determined coefficient is a linear combination of a first parameter and a second parameter, wherein the first parameter is a measure of the spectral distance, and wherein the second parameter is a measure of how far said spectral distance is to a low-passed spectral distance of past frames.

5. The method according to claim 1, wherein the postfilter control parameter is a function of a normalized pitch correlation.

6. A method in a postfilter for improving perceived quality of speech reconstructed at a speech decoder, the method comprises the steps of:

receiving, using a processor, a determined coefficient to the postfilter from a postfilter control apparatus, where the postfilter control apparatus is configured to measure stationarity of a speech signal reconstructed at the speech decoder by determining a spectral distance between adjacent frames of the speech signal, and adaptively determining a coefficient to a postfilter control parameter, such that when a spectral distance is determined to be high, a degree of deemphasizing of spectral valleys in a spectral envelope of the reconstructed speech signal is reduced compared with a situation when a spectral distance is determined to be low, and processing, using the processor, the reconstructed speech signal by applying the determined coefficient to the postfilter control parameter to obtain an enhanced speech signal.

7. The method according to claim 6, wherein the spectral distance is an immittance spectral frequencies (ISF) distance.

8. The method of claim 6, wherein the spectral distance is a line spectral frequencies (LSF) distance.

9. The method according to claim 6, wherein the determined coefficient is a linear combination of a first parameter and a second parameter, wherein the first parameter is a measure of the spectral distance, and wherein the second parameter is a measure of how far said spectral distance is to a low-passed spectral distance of past frames.

10. The method according to claim 6, wherein the postfilter control parameter is a function of a normalized pitch correlation.

11. A postfilter control apparatus to be associated with a postfilter for improving perceived quality of speech reconstructed at a speech decoder, the postfilter control apparatus comprises:

a postfilter processor;

a non-transitory computer-readable storage medium, coupled to the postfilter processor, said non-transitory computer-readable storage medium further comprising computer-readable instructions, when executed by the postfilter processor, are configured for:

measuring stationarity of a speech signal reconstructed at the speech decoder by determining a spectral distance between adjacent frames of the speech signal adaptively determining a coefficient to a postfilter control parameter, such that when a spectral distance is determined to be high, a degree of deemphasizing of spectral valleys in a spectral envelope of the reconstructed speech signal is reduced compared with a situation when a spectral distance is determined to be low, and transmitting the determined coefficient to a postfilter, such that the postfilter can process the reconstructed speech signal by applying the determined coefficient to the postfilter control parameter to obtain an enhanced speech signal.

12. The postfilter control apparatus according to claim 11, wherein the spectral distance is an immittance spectral frequencies (ISF) distance.

13. The postfilter control apparatus according to claim 11, wherein the spectral distance is a line spectral frequencies (LSF) distance.

14. The postfilter control apparatus according to claim 11, wherein the determined coefficient is a linear combination of a first parameter and a second parameter, wherein the first parameter is a measure of the spectral distance, and wherein the second parameter is a measure of how far said spectral distance is to a low-passed spectral distance of past frames.

15. The postfilter control apparatus according to claim 11, wherein the postfilter control parameter is a function of a normalized pitch correlation.

16. A postfilter for improving perceived quality of speech reconstructed at a speech decoder, the postfilter comprises:

a processor for receiving a determined coefficient to the postfilter from a postfilter control apparatus, wherein the postfilter control apparatus is configured to measure stationarity of a speech signal reconstructed at the speech decoder by determining a spectral distance between adjacent frames of the speech signal and adaptively determining a coefficient to a postfilter control parameter, such that when a spectral distance is determined to be high, a degree of deemphasizing of spectral valleys in a spectral envelope of the reconstructed speech signal is reduced compared with a situation when a spectral distance is determined to be low, and a processor for processing the reconstructed speech signal by applying the determined coefficient to the postfilter control parameter to obtain an enhanced speech signal.

17. The postfilter according to claim 16, wherein spectral distance is an immittance spectral frequencies (ISF) distance.

18. The postfilter according to claim 16, wherein the spectral distance is a line spectral frequencies (LSF) distance.

19. The postfilter according to claim 16, wherein the determined coefficient is a linear combination of a first parameter and a second parameter, wherein the first parameter is a measure of the spectral distance, and wherein the second parameter is a measure of how far said spectral distance is to a low-passed spectral distance of past frames.

20. The postfilter according to claim 16, wherein the postfilter control parameter is a function of a normalized pitch correlation.

* * * * *

UNITED STATES PATENT AND TRADEMARK OFFICE

CERTIFICATE OF CORRECTION

PATENT NO. : 9,076,453 B2
APPLICATION NO. : 14/278934
DATED : July 7, 2015
INVENTOR(S) : Grancharov It is certified that error appears in the above-identified patent and that said Letters Patent is hereby corrected as shown below:

On Title Page 2, in item (56), under "OTHER PUBLICATIONS", in Column 2, Line 13, delete "Speech," and insert -- Speech --, therefor.

In the Specification

In Column 1, Line 4, delete "§119(e)" and insert -- § 119(e) --, therefor.

In Column 1, Line 7, delete "2013," and insert -- 2013, now Pat. No. 8,731,917, --, therefor.

In Column 2, Line 61, delete "receiveing" and insert -- receiving --, therefor.

In Column 3, Line 16, delete "receiveing" and insert -- receiving --, therefor.

In Column 4, Line 39, delete "parameter 208" and insert -- parameter. --, therefor.

In Column 4, Line 53, delete "immitance" and insert -- immittance --, therefor.

In Column 5, Line 47, delete "receiveing" and insert -- receiving --, therefor.

In the Claims

In Column 7, Line 20, in Claim 11, delete "signal" and insert -- signal, --, therefor.

Signed and Sealed this
Third Day of May, 2016

Michelle K. Lee

Michelle K. Lee
*Director of the United States Patent and Trademark Office*